US012778280B2

(12) United States Patent
Li

(10) Patent No.: US 12,778,280 B2
(45) **Date of Patent: *Nov. 3, 2026**

(54) LIFTING DESK

(71) Applicant: NINGBO HEALTHKEY MOTION TECHNOLOGY CO., LTD, Ningbo (CN)

(72) Inventor: Wentao Li, Ningbo (CN)

(73) Assignee: NINGBO HEALTHKEY MOTION TECHNOLOGY CO., LTD, Ningbo (CN)

( * ) Notice: Subject to any disclaimer, the term of this patent is extended or adjusted under 35 U.S.C. 154(b) by 65 days.

This patent is subject to a terminal disclaimer.

(21) Appl. No.: 19/028,427

(22) Filed: Jan. 17, 2025

(65) Prior Publication Data

US 2025/0160509 A1 May 22, 2025

Related U.S. Application Data

(63) Continuation of application No. 18/029,763, filed as application No. PCT/CN2021/143587 on Dec. 31, 2021, now Pat. No. 12,245,696.

(30) Foreign Application Priority Data

Mar. 10, 2021 (CN) ..... 202120510298.6

(51) Int. Cl.
*A47B 9/04* (2006.01)
*A47B 9/08* (2006.01)

(52) U.S. Cl.
CPC ..... *A47B 9/04* (2013.01); *A47B 9/08* (2013.01); *A47B 2009/046* (2013.01)

(58) Field of Classification Search
CPC .... A47B 9/04; A47B 9/08; A47B 9/06; A47B 9/20; A47B 2009/046; A47B 2009/065;
(Continued)

(56) References Cited

U.S. PATENT DOCUMENTS

| | | | |
|---|---|---|---|
| 6,474,246 | B2 | 11/2002 | Hsu |
| 2008/0178779 | A1 | 7/2008 | Agee |
| 2017/0224101 | A1 | 8/2017 | Bruder et al. |

FOREIGN PATENT DOCUMENTS

| | | | |
|---|---|---|---|
| CN | 108741623 | A | 11/2018 |
| CN | 108991727 | A | 12/2018 |

(Continued)

OTHER PUBLICATIONS

Mar. 23, 2022 International Search Report issued in International Patent Application No. PCT/CN2021/143587.

(Continued)

*Primary Examiner* — Janet M Wilkens
(74) *Attorney, Agent, or Firm* — Oliff PLC

(57) ABSTRACT

A lifting desk is related to fields of lifting desks. The lifting desk includes a drive device, a gearbox, a desktop, a crossbeam, and a lifting column, the crossbeam being connected to the desktop, the lifting column being connected to the crossbeam, the gearbox including a gear assembly, the drive device being in driving engagement with the gear assembly, the gear assembly being in driving engagement with the lifting column; the lifting desk further includes a retaining plate, the retaining plate being securely connected to the desktop, the gearbox being connected to the retaining plate. The desk offers an advantage that the structure disclosed may enhance assembly precision of the lifting desk and enables lifting control of the desktop.

7 Claims, 5 Drawing Sheets

(58) Field of Classification Search
CPC ..... A47B 17/02; A47B 21/0314; A47B 21/02; A47B 21/04; A47B 2200/0071; A47B 2200/0075; A47B 2200/12; A47B 2200/0073; A47B 2200/0097; A47B 2200/0062; A47B 2200/0051; A47B 2200/0056; A47B 2200/0054; A47B 2200/0058; A47B 2200/0059; A47B 2021/0364; A47B 2021/066
USPC ..... 108/144.11, 147, 20, 147.19, 96; 248/188.2, 188.5
See application file for complete search history.

(56) References Cited

FOREIGN PATENT DOCUMENTS

| | | | | | |
|---|---|---|---|---|---|
| CN | 208821853 | U | | 5/2019 | |
| CN | 210960858 | U | | 7/2020 | |
| CN | 211065480 | U | | 7/2020 | |
| CN | 212489000 | U | | 2/2021 | |
| CN | 112716135 | A | | 4/2021 | |
| CN | 112971342 | A | | 6/2021 | |
| CN | 213846453 | U | | 7/2021 | |
| CN | 214904563 | U | | 11/2021 | |
| CN | 116636691 | A | * | 8/2023 | ..... A47B 9/20 |
| DE | 20 2015 106 942 | U1 | | 1/2016 | |
| EP | 2823731 | A2 | | 1/2015 | |
| KR | 20160058559 | A | | 5/2016 | |
| WO | 2004/100632 | A1 | | 11/2004 | |
| WO | 2013/159775 | A1 | | 10/2013 | |

OTHER PUBLICATIONS

Mar. 23, 2022 Written Opinion issued in International Patent Application No. PCT/CN2021/143587.
Mar. 4, 2024 Extended Search Report issued in European Patent Application No. 21929989.8.
English translation KR20160058559 (Year: 2016).
Mar. 31, 2025 Office Action issued in European Patent Application No. 21929989.8.

* cited by examiner

LIFTING DESK

This application is a continuation application of U.S. patent application Ser. No. 18/029,763 filed Mar. 31, 2023, which is a national phase of International Patent Application No. PCT/CN2021/143587 filed Dec. 31, 2021, which claims the benefit of Chinese Patent Application No. 2021205102986 filed Mar. 10, 2021. The disclosure of the prior applications is hereby incorporated by references herein in its entirety.

FIELD

The disclosure relates to the field of lifting desks and more particularly relates to a lifting desk.

BACKGROUND

A conventional lifting desk comprises a desktop, a crossbeam, a drive device, a gearbox, and a lifting column, the crossbeam being screw-connected to the desktop, the lifting column being in driving engagement with the gearbox, the drive device driving, via movement transfer by the gearbox, the lifting column to move; a mounting plate connected to the crossbeam is provided on the lifting column; the lifting desk further comprises a bottom end plate, the bottom end plate being disposed between the gearbox and the lifting column and being screw-connected to the crossbeam, the mounting plate being connected to the bottom end plate, the gearbox being connected to the bottom end plate; a through-hole is provided on the bottom end plate, through which a lead screw in the lifting column is connected to a gear assembly inside the gearbox. With this structure, the drive device may drive the lifting column to move. The lifting column and the gearbox may be both mounted on the crossbeam, facilitating assembly of the lifting desk.

However, the screw-connected mounting manner would introduce screw-hole fitting errors. In the structure described above, fitting errors likely occur to the screw connection between the crossbeam and the desktop, the screw connection between the bottom end plate and the crossbeam, and the connection between the gearbox and the bottom end plate, leading to a large assembly error and a low assembly precision of the gearbox, further deteriorating assembly precision of the lifting desk.

SUMMARY

To solve the above and other technical problems in conventional lifting desks, embodiments of the present disclosure provide a lifting desk with an enhanced assembly precision.

In some embodiments, a lifting desk comprises a drive device, a gearbox, a desktop, a crossbeam, and a lifting column, the crossbeam being connected to the desktop, the lifting column being connected to the crossbeam, the gearbox comprising a gear assembly, the drive device being in driving engagement with the gear assembly, the gear assembly being in driving engagement with the lifting column; the lifting desk further comprises a retaining plate, the retaining plate being securely connected to the desktop, the gearbox being connected to the retaining plate.

In some embodiments, the retaining plate is disposed between the gearbox and the desktop, a screw connection being configured between the retaining plate and the desktop, a screw connection being configured between the gearbox and the retaining plate. This screw-connection manner not only optimizes the structure of the retaining plate to give the retaining plate a relatively large strength, but also facilitates mounting of the retaining plate and the gearbox.

In some embodiments, the retaining plate comprises a first section and a second section which are bent relative to each other, the first section being connected to the gearbox, the second section being connected to the drive device; as such, the drive device may be fixed relative to the desktop, and meanwhile, the structure of the lifting desk is optimized to become simpler.

In some embodiments, a bend angle between the first section and the second section is 90°, which allows for mounting of the drive device along a horizontal direction, thereby facilitating mounting of the drive device.

In some embodiments, the lifting column comprises a lead screw, a lifting column tubular component, a mounting plate and a locking device, the locking device being detachably connected to the lead screw, the mounting plate being tightly clamped between the locking device and the lifting column tubular component; as such, the mounting plate may be fixed, thereby facilitating mounting of the lifting column.

In some embodiments, the locking device refers to a locking screw, and a bearing and a bearing seat holding the bearing are provided on the lead screw, the bearing seat being connected to the mounting plate; this not only enables axial positioning of the mounting plate relative to the lead screw, but also enables circumferential rotation of the lead screw relative to the mounting plate, preventing the mounting plate from limiting rotation of the lead screw.

In some embodiments, the lifting desk further comprises a first spline and a second spline which are fitted with each other, the first spline being in driving engagement with the gear assembly, the second spline being in driving engagement with the lead screw; this allows for the lifting column to be in driving engagement with the gearbox.

In some embodiments, a positioning housing is sleeved outside the second spline, one end of the second spline abutting against the locking screw, the other end thereof abutting against the positioning housing, the positioning housing being connected to the bearing seat; this may protect the first spline and the second spline, prevent the first spline and the second spline from colliding to cause damages, and may further enhance steadiness of the lifting desk.

In some embodiments, the positioning housing comprises a first positioning lug, the bearing seat comprises a second positioning lug, and the mounting plate is provided with a first through-hole, the first positioning lug, the second positioning lug, and the first through-hole being connected, whereby the positioning housing, the bearing seat, and the mounting plate may be connected together.

In some embodiments, the positioning housing comprises two first positioning lugs oppositely arranged, the bearing seat comprises two second positioning lugs oppositely arranged, and the mounting plate is provided with two first through-holes oppositely arranged; this further limits displacement of the mounting plate, whereby the mounting plate is more steady after being mounted.

The present disclosure offers the following advantages:

Firstly, the crossbeam is connected to the desktop, the retaining plate is connected to the desktop, and the gearbox is connected to the desktop; in this way, when screw connection is adopted between the retaining plate and the desktop and between the gearbox and the retaining plate, the screw fitting error only occurs between the retaining plate and the desktop and between the gearbox and the retaining plate in the process of mounting the gearbox; compared with the prior art, no screw fitting error occurs between the crossbeam and the retaining plate when mounting the gearbox in the present application, which may enhance mounting precision of the gearbox and further enhance assembly precision of the lifting desk.

Secondly, in the present application, the lifting column may be directly connected to the crossbeam and the gearbox may be directly connected to the desktop. Compared with a conventional structure in which both the lifting column and the gearbox are connected to the bottom end plate and further connected to the crossbeam via the bottom end plate, mounting of the lifting column and mounting of the gearbox in the present application do not interfere with each other, and the fitting precision between the lifting column and the gearbox may be improved by adjusting the mounting position of the gearbox or the mounting position of the lifting column.

In addition, in the prior art, the bottom end plate is connected to both of the gearbox and the lifting column such that a through-hole is needed on the bottom end plate to allow for the lead screw of the lifting column to pass through for being connected to the gear assembly inside the gearbox; if the through-hole's diameter is relatively large, the bottom end plate's strength would be lowered due to reduced area; if the through-hole's diameter is relatively small, a part with a larger diameter cannot be inserted into the though-hole; as such, the through-hole on the bottom end plate has an impact on mounting and connection of the gearbox and the lifting column. However, in the present application, the retaining plate is not connected to the lifting column, such that no through-hole is needed on the retaining plate. Without a through-hole on the retaining plate, mounting and connection of the gearbox and the lifting column, as well as the size of the retaining plate, are not affected, which facilitates machining and mounting of the mounting plate and further facilitates machining and assembly of the lifting desk.

The features and advantages of the present disclosure as described above will be disclosed in detail through specific implementations with reference to the accompanying drawings below.

BRIEF DESCRIPTION OF THE DRAWINGS

The disclosure will be further described in detail with reference to the accompanying drawings below, in which.

REFERENCE NUMERALS

1. desktop; 2. lifting column; 3. drive device; 4. crossbeam; 5. side plate; 6. retaining plate; 7. first bevel gear; 8. second bevel gear; 9. first spline; 10. first screw; 11. first bearing; 12. second spline; 13. second screw; 14. positioning housing; 15. second bearing; 16. bearing seat; 17. mounting plate; 18. lead screw; 19. lifting column tubular component; 20. gearbox; 21. first positioning lug; 22.second positioning lug; 23. first through-hole.

DETAILED DESCRIPTION

Hereinafter, the technical solutions of the present disclosure will be explained and illustrated through embodiments with reference to the accompanying drawings. However, the embodiments are only preferred embodiments of the present disclosure, not all of them. Other embodiments derived by those skilled in the art without exercise of inventive work based on the examples in the embodiments all fall within the protection scope of the present disclosure.

In the description of the present disclosure, it needs to be understood that the orientational or positional relationships indicated by the terms "inner," "outer," "upper," "lower," "left," and "right," refer to those orientational and positional relationships based on the drawings, which are intended only for facilitating description of the disclosure and simplifying relevant illustrations, but not for indicating or implying that the devices or elements compulsorily possess those specific orientations and are compulsorily configured and operated with those specific orientations; therefore, such terms should not be construed as limitations to the present disclosure.

Figure 1:
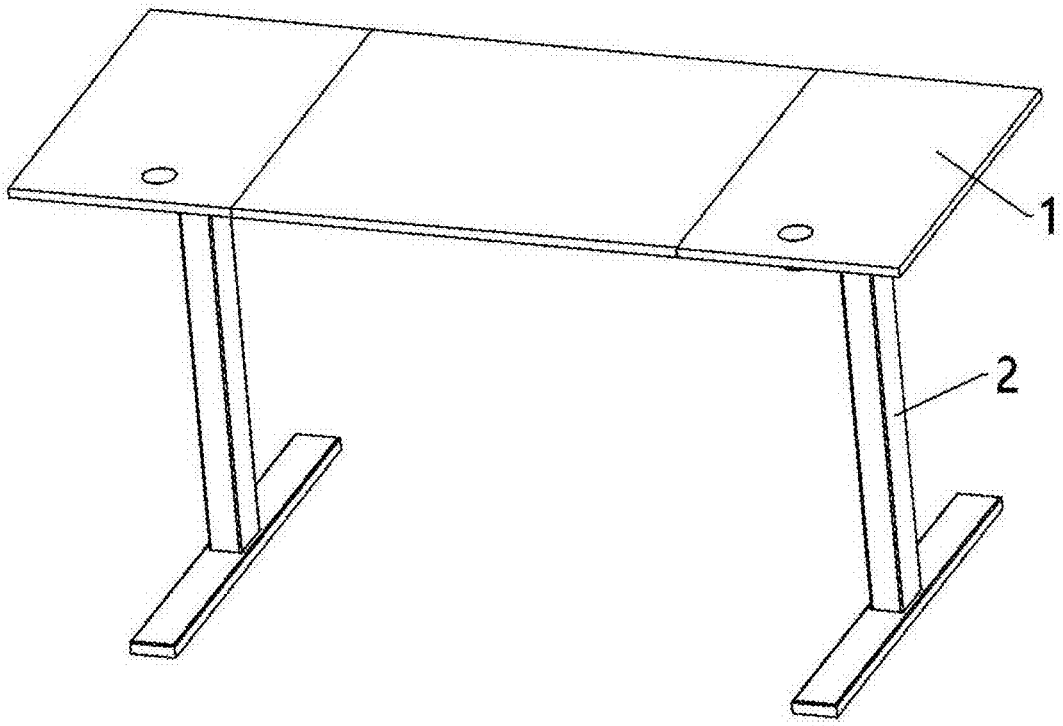
FIG. 1 shows a front view of a lifting desk according to the disclosure.
Figure 2:
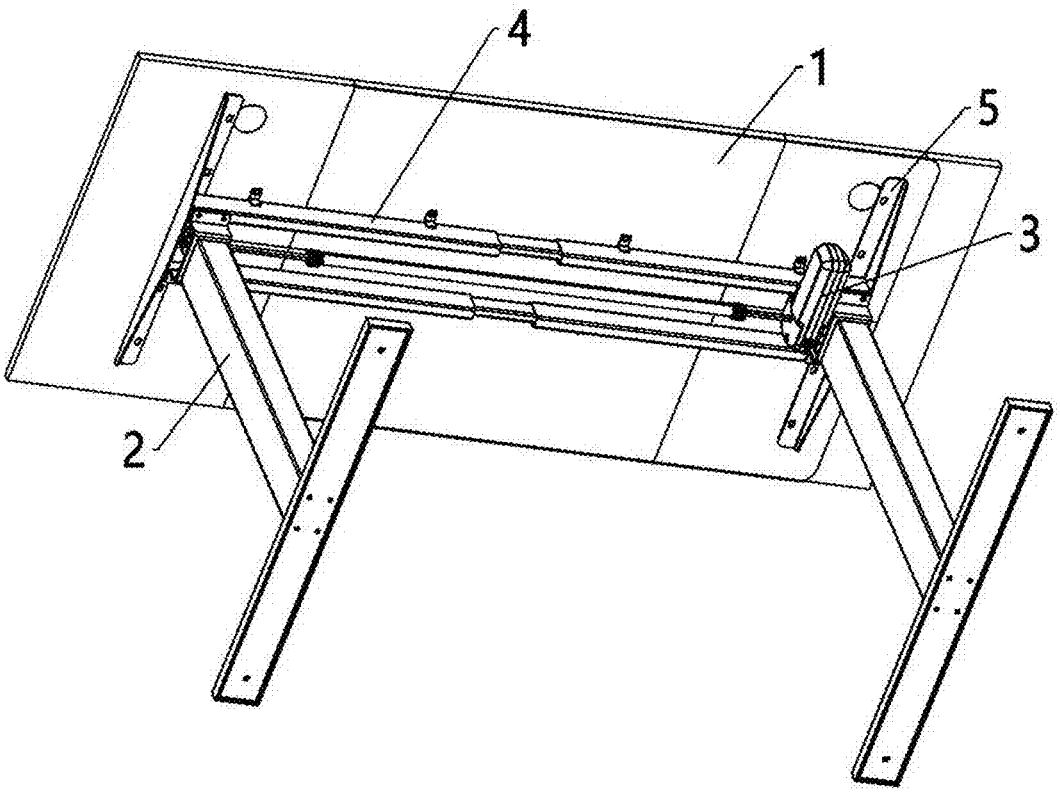
FIG. 2 shows a rear view of the lifting desk according to the disclosure.
Figure 3:
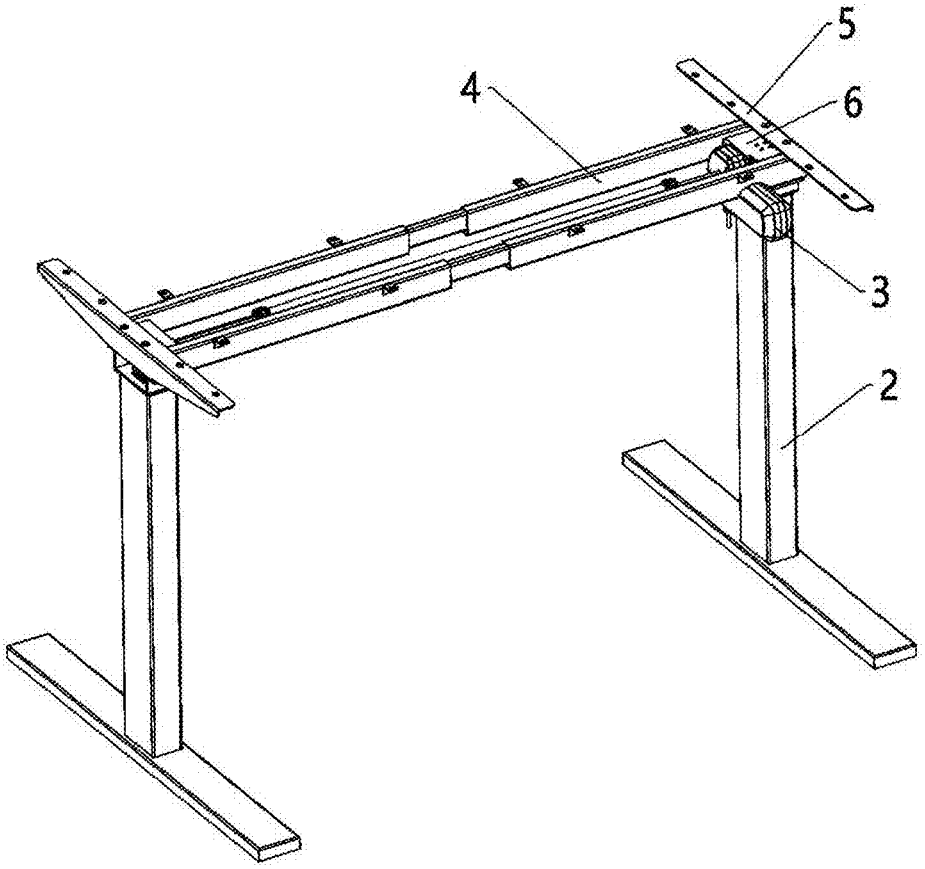
FIG. 3 shows a schematic diagram of the lifting desk with a desktop removed according to the disclosure.
Figure 4:
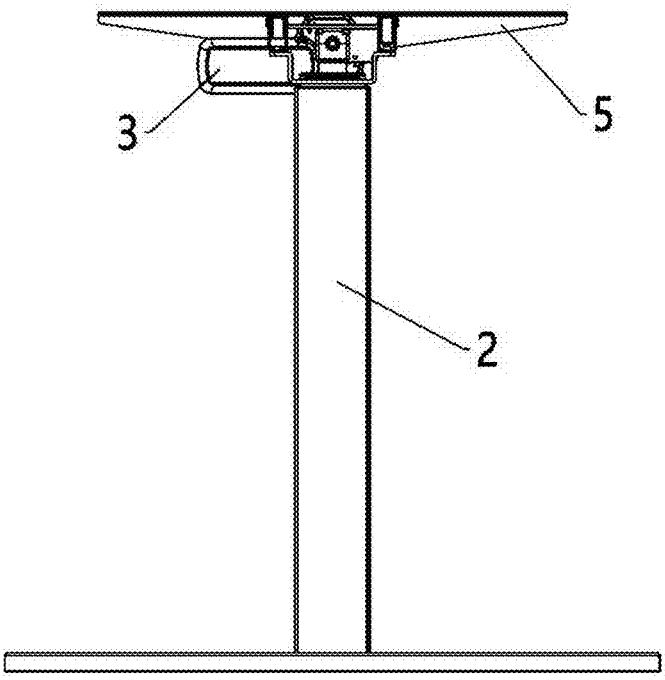
FIG. 4 shows a side view of the lifting desk with the desktop removed according to the disclosure.
Figure 5:
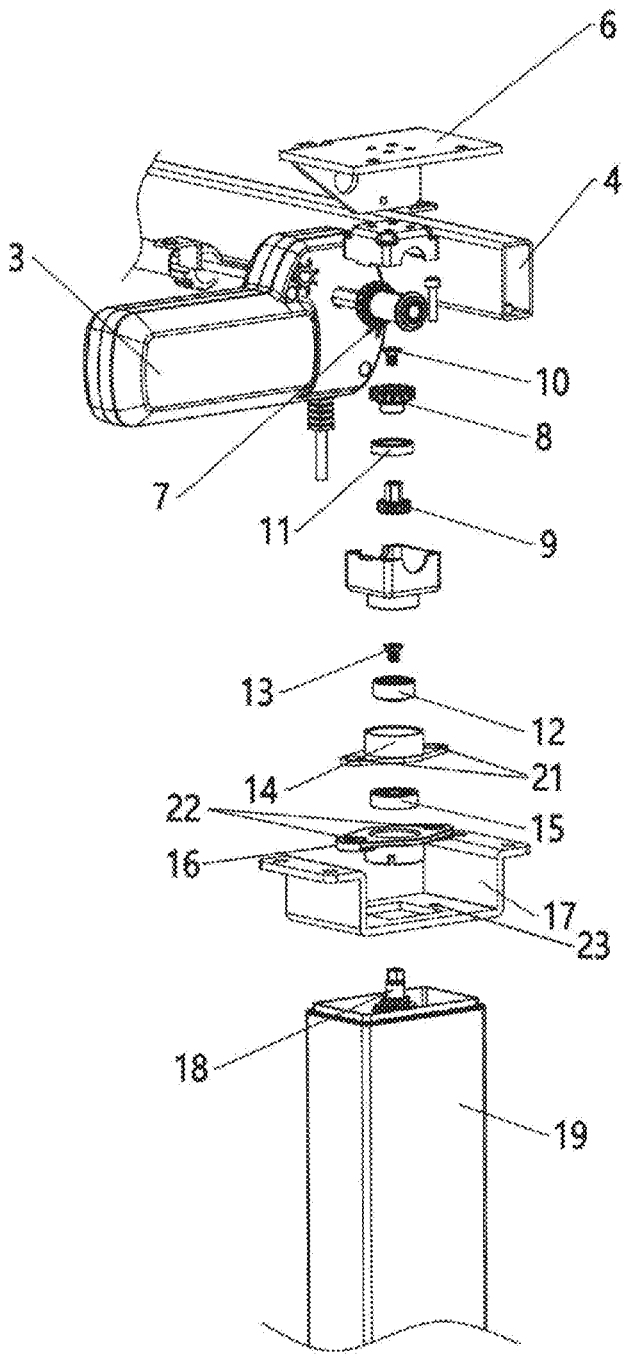
FIG. 5 shows a local exploded view of a gearbox and a lifting column according to the disclosure.
Figure 6:
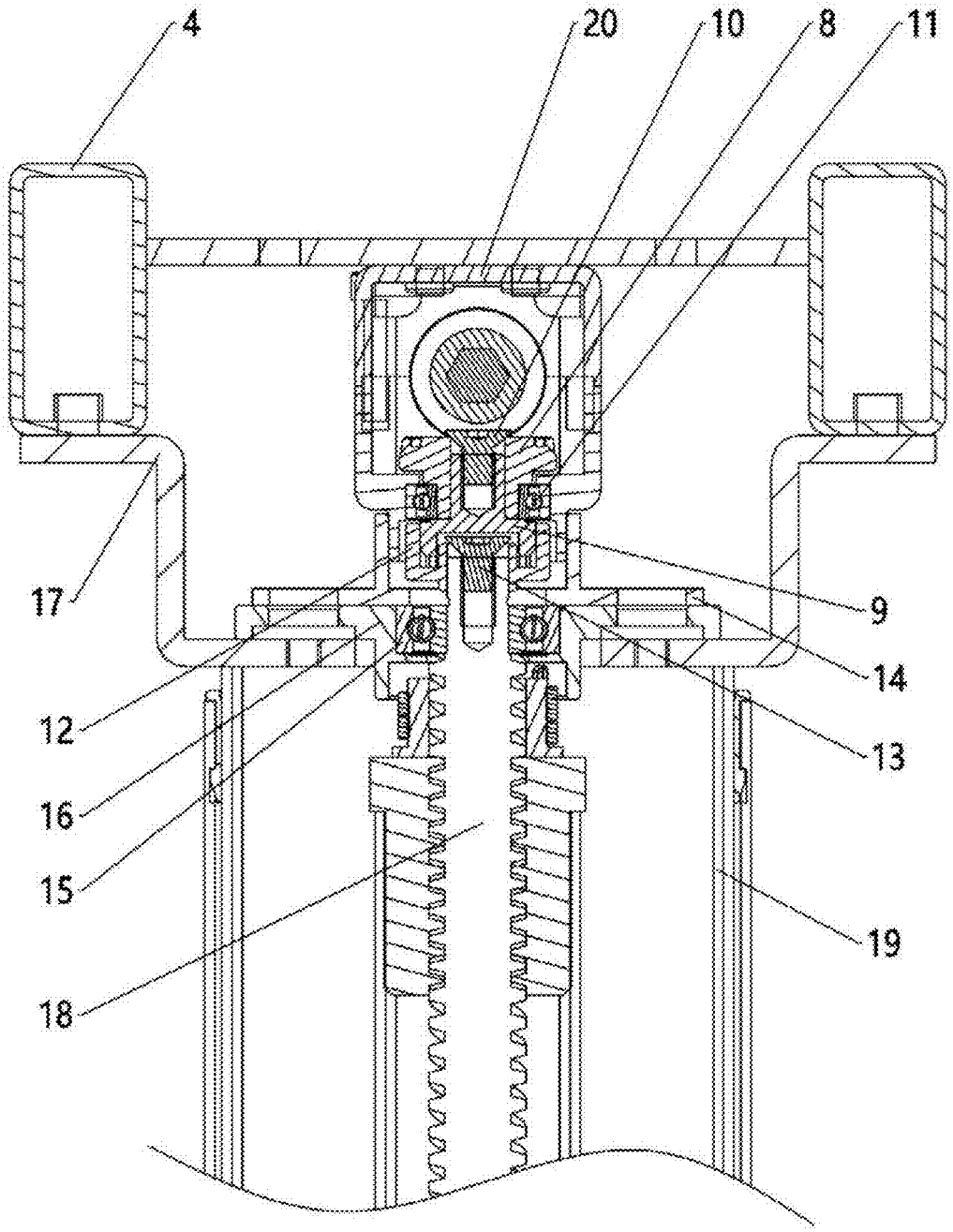
FIG. 6 shows a partial sectional view of the lifting desk according to the disclosure.
Figure 7:
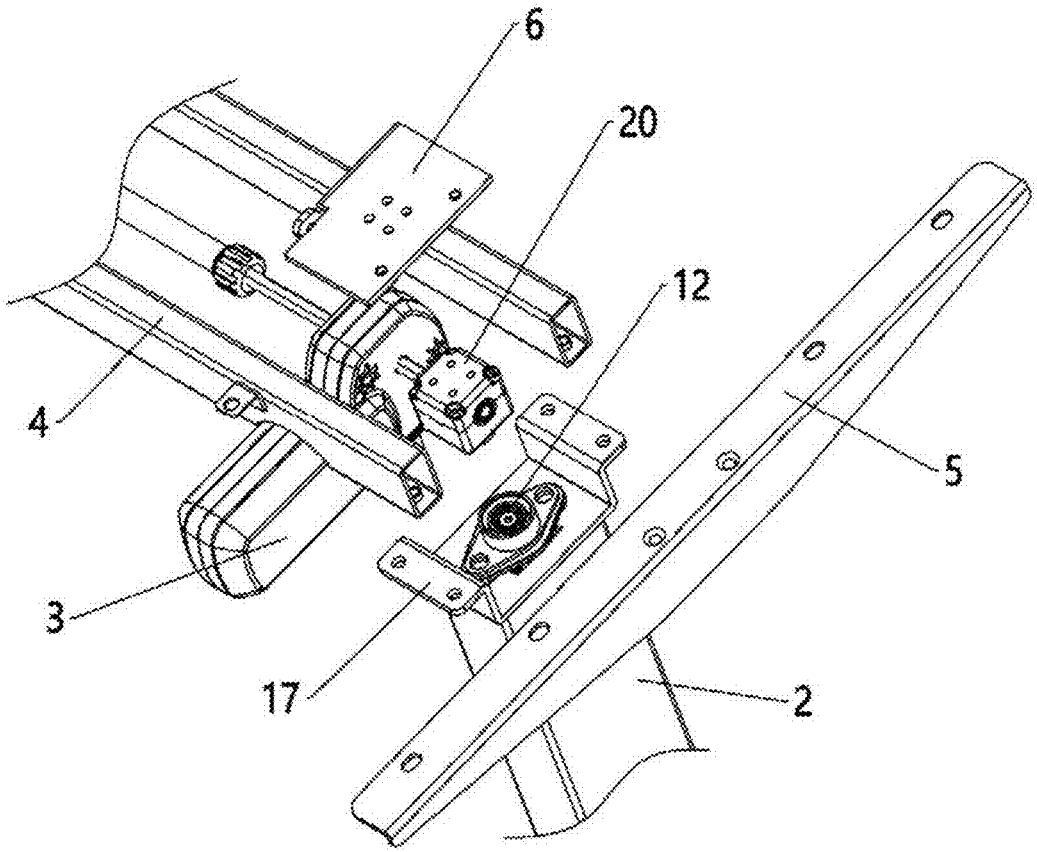
FIG. 7 shows a local exploded view of the lifting column according to the disclosure.
Figure 8:
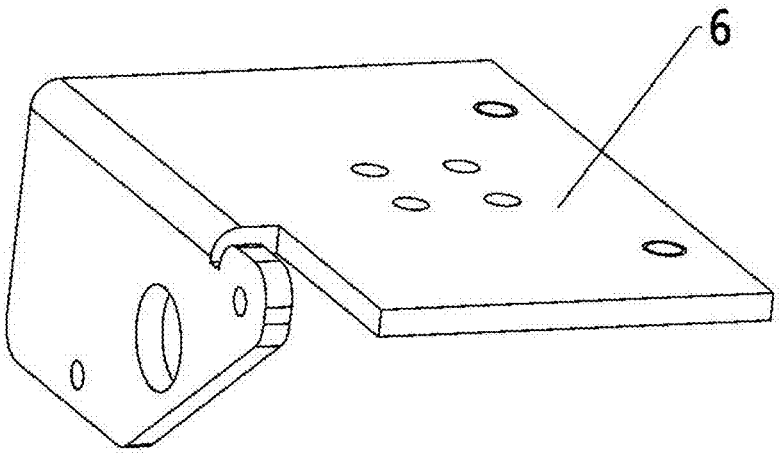
FIG. 8 shows a schematic view of a retaining plate according to the disclosure.

As illustrated in FIGS. 1 to 8, in this embodiment, a lifting desk comprises: a drive device 3, a gearbox 20, a desktop 1, a crossbeam 4, and a lifting column 2, the crossbeam 4 being attached to the desktop 1, the lifting column 2 being connected to the crossbeam 4, the gearbox 20 comprising a gear assembly, the drive device 3 being in driving engagement with the gear assembly, the gear assembly being in driving engagement with the lifting column 2; the lifting desk further comprises a retaining plate 6, the retaining plate 6 being fixedly attached to the desktop 1, the gearbox 20 being connected to the retaining plate 6.

In this embodiment, the retaining plate 6 is screw-connected to the desktop 1, the gearbox 20 is screw-connected to the retaining plate 6, and the retaining plate 6 is disposed between the gearbox 20 and the desktop 1; upon assembly, a screw may be mounted downward from above the retaining plate 6 to connect the retaining plate 6 to the gearbox 20, and a screw may be mounted upward from below the retaining plate 6 to connect the retaining plate 6 to the desktop 1, whereby mounting and retaining of the gearbox 20 are facilitated. In addition, the lifting desk further comprises a side plate 5, a through-hole being configurable on the side plate 5, a screw passing through the hole on the retaining plate 6 and the through-hole on the side plate 5 to connect the side plate 6 to the desktop 1; in this way, the side plate 5 may further limit the retaining plate 6 from being displaced, whereby secureness of the mounted retaining plate 6 is enhanced.

The retaining plate 6 comprises a first section and a second section which are bent relative to each other. The first section is connected to the gearbox 20 and the second section is connected to the drive device 3, such that the retaining plate 6 may not only connect the gearbox 20 but also connect the drive device 3; in this way, the drive device 3 may be secured relative to the desktop 1. A bend angle between the first section and the second section may be 90°, in which case the drive device 3 may be securely mounted along the horizontal direction, whereby mounting of the drive device 3 is facilitated.

In this embodiment, the lifting desk comprises a desktop 1 and two lifting columns 2, and the drive device 3 simultaneously drives the two lifting columns 2 to move via a transmission assembly. The transmission assembly comprises two hexagonal rods and one drive rod, the two hexagonal rods being respectively connected to two gearboxes 20, two ends of the drive rod being respectively connected to the two hexagonal rods, such that the drive device 3 may drive, via the hexagonal rod, the lifting column 2 proximal thereto to move, and drive, via movement transfer by the drive rod, the lifting column 2 distal therefrom to move.

Each gearbox 20 comprises an upper housing, a lower housing, and a gear assembly, the upper housing and the lower housing being screw-connected to form a cavity, the gear assembly being disposed in the cavity; the gear assembly comprises a first bevel gear 7 and a second bevel gear 8, the first bevel gear 7 being connected to the hexagonal rods and circumferentially positioned such that the drive device 3 may drive, via the hexagonal rod, the first bevel gear 7 to rotate. The axis of the first bevel gear 7 is perpendicular to that of the second bevel gear 8 such that when the straight line where the motor shaft of the drive device 3 is located becomes perpendicular to the straight line where the lead screw 18 of the lifting column 2 is located, the drive device 3 may still drive the lifting column 2 to move via the gear assembly, which also allows for horizontal mounting of the drive device 3, whereby mounting of the drive device 3 is facilitated.

The second bevel gear 8 has a shoulder extended axially, a first bearing 11 being provided on the shoulder; an inner race of the first bearing 11 may be interference-fitted with the shoulder and an outer race thereof may be interference-fitted with the lower housing, such that the first bevel gear 7 is rotatable within the lower housing, and with support by the first bearing 11, steadiness of the first bevel gear 7 is enhanced.

A first hole is provided inside the second bevel gear 8, the first hole being coaxial with the second bevel gear 8; a first spline 9 has a positioning seat extended circumferentially, the positioning seat being inserted into the first hole; the first spline 9 abuts against the first bearing 11 along the axial direction; the positioning seat has a hexagonal cross section which is fitted with the first hole, such that the first bevel gear 7 may bring the first spline 9 to rotate synchronously. A screw hole is provided at one end of the positioning seat. The lifting desk comprises a first screw 10. The first screw 10 is connected to the screw hole on the positioning seat. The axis of the first screw 10 coincides with that of the second bevel gear 8. The first screw 10 has a round head with a cross-sectional area greater than that of the first hole such that the head of the first screw 10 may block the second bevel gear 8 from moving towards the head side of the first screw 10; meanwhile the first screw 10 enables tight clamping of the second bevel gear 8, the first bearing 11, and the first spline 9, allowing for axial positioning of the three.

The first spline 9 and the second spline 12 may be fitted in a female-male fashion; or, the first spline 9 may have a plurality of protrusions extended axially and spaced apart from each other, and the second spline 12 has a plurality of protrusions extended axially, the protrusions of the second spline 12 being axially fitted into the spacings between the plurality of protrusions of the first spline 9 such that the first spline 9 and the second spline 12 are interleaving-fitted to enable circumferential positioning. In the case of female-male fitting fashion between the first spline 9 and the second spline 12, the female spline is sleeved outside the male spline such that the male spline may be radially positioned by the female spline, whereby connection secureness between the first spline 9 and the second spline 12 is reinforced.

In this embodiment, the first spline 9 is a male spline and the second spline 12 is a female spline. The lifting column 2 is in driving engagement with the gear assembly by fitting the second spline 12 into the first spline 9. The lower housing has a positioning ring extended axially, such that when the second spline 12 is fitted into the first spline 9, the positioning ring is sleeved outside the second spline 12 to enable radial retaining of the second spline 12, whereby the first spline 9 and the second spline 12 are positioned more steadily.

The second spline 12 is sleeved over the lead screw 18. A second hole is provided on the second spline 12, the second hole being coaxial with the second spline 12. The front end of the lead screw 18 is of a hexagonal shape and fitted with the second hole such that the second spline 12 and the lead screw 18 are circumferentially positioned. A screw hole is provided at the front end of the lead screw 18. The lifting desk comprises a second screw 13, the second screw 13 being inserted into the screw hole on the lead screw 18. The head of the second screw 13 is of a round shape with a cross-sectional area greater than that of the second hole, whereby axial movement of the second spline 12 is limited, which prevents the second spline 12 from slipping off from the front end of the lead screw 18.

The lifting column 2 comprises a lead screw 18, a lifting column tubular component 19, a mounting plate 17, and a locking device, the locking device being detachably connected to the lead screw 18, the mounting plate 17 being tightly clamped between the locking device and the lifting column tubular component 19. The locking device may be a thread-fastening device or a rotation-snapping knob, or a press-snapping button. The locking device may comprise a housing, a bearing being configurable between the housing and the locking member inside such that the housing is rotatable relative to the locking member. A locking action of the locking member may bring the housing to move axially to press the mounting plate tightly. The lifting column tubular component 19 refers to a tubular component of the lifting column 2, which may be a tubular component telescoped during lifting of the lifting column 2 or a tubular component non-telescoped during lifting of the lifting column 2. The locking device may be coupled to the lead screw 18 and configured to press the mounting plate 17 tightly on a front end face of the lifting column tubular component 19, whereby the mounting plate 17 may be fixed. Alternatively, the mounting plate 17 may be pressed tightly on the front end face of the lifting column tubular component 19 by pressing the second spline 12 tightly.

Since the mounting plate 17 is nonrotatable relative to the lead screw 18, a second bearing 15 and a bearing seat 16 for securely holding the bearing are provided on the lead screw 18, the bearing seat 16 being connected to the mounting plate 17, the second bearing 15 being configured such that rotation of the lead screw 18 does not bring the bearing seat 16 and the mounting plate 17 to rotate. Furthermore, the second bearing 15, the bearing seat 16, and the mounting plate 17 may be sequentially clamped tightly between the locking device and the lifting column tubular component 19; or, the second spline 12, the second bearing 15, the bearing seat 16, and the mounting plate 17 may be sequentially clamped tightly between the locking device and the lifting column tubular component 19.

A positioning housing 14 is sleeved outside the second spline 12. The positioning housing 14 may envelop the second spline 12 inside to protect the second spline 12. Provision of the positioning housing 14 may prevent the second spline 12 from being damaged or broken in case of collisions and may also enhance steadiness of the lifting desk. A gap exists radially between the second spline 12 and the positioning housing 14 such that rotation of the second spline 12 does not cause friction with the positioning housing 14 affecting service life of the second spline 12. The positioning housing 14 is attached to the bearing seat 16 and the mounting plate 17; this not only enables fixation of the positioning housing 14 but also encapsulates the front end of the lifting column 2 such that the lifting column 2 may be shipped and mounted as an entirety, thereby facilitating assembly and shipping of the lifting desk.

In this embodiment, the locking device refers to the second screw 13 with the second spline 12 abutting against the positioning housing 14. The second screw 13 presses the mounting plate 17 tightly between the second screw 13 and the lifting column tubular component 19 by sequentially pressing the second spline 12, the positioning housing 14, and the bearing seat 16 tightly. In this embodiment, the positioning housing 14 comprises two first positioning lugs 21 oppositely arranged, the bearing seat 16 comprises two second positioning lugs 22 oppositely arranged, and on the mounting plate 17 are provided two first through-holes 23 oppositely arranged. Corresponding first positioning lugs 21, corresponding second positioning lugs 22, and corresponding first through-holes 23 are connected. The first positioning lugs 21, the second positioning lugs 22, and the first through-holes 23 may be screw-connected therebetween. By positioning via the two first positioning lugs 21 and the two second positioning lugs 22, steadiness of the mounting plate 17 and the lifting column 2 may be further enhanced, and rotation of the mounting plate 17 may be further limited.

In this embodiment, the mounting plate 17 is a U-shaped plate, comprising a bottom plate and two side plates, the bottom plate abutting against the lifting column tubular component 19, each side plate having a positioning protrusion extended horizontally, the positioning protrusion being connected to the crossbeam 4; this design enables connection of the lifting column 2 to the crossbeam 4. The U-shaped space in the mounting plate 17 is adapted to accommodate the first spline 9, the second spline 12, the second bearing 15, and the bearing seat 16.

What have been described above are only embodiments of the present disclosure; however, the protection scope of the present disclosure is not limited thereto. A person skilled in the art should understand that the disclosure includes, but is not limited to, the contents described in the drawings and the embodiments. Any modifications without departing from the functions and structural principles of the disclosure will be included within the scope of the claims.

What is claimed is:

1. A lifting desk, comprising:

a drive device;

a gearbox comprising a gear assembly, the drive device being in driving engagement with the gear assembly;

a desktop;

a crossbeam connected to the desktop;

a lifting column connected to the crossbeam, the gear assembly being in driving engagement with the lifting column, wherein the lifting column comprises a lead screw on which are provided a bearing and a bearing seat holding the bearing, a lifting column tubular component, a mounting plate, and a locking screw detachably connected to the lead screw, the mounting plate being tightly clamped between the locking screw and the lifting column tubular component, and connected to the bearing seat that is provided on the lead screw;

a retaining plate, the retaining plate being securely connected to the desktop, the gearbox being connected to the retaining plate;

a first spline and a second spline which are fitted with each other, the first spline being in driving engagement with the gear assembly, the second spline being in driving engagement with the lead screw; and a positioning housing that is sleeved outside the second spline, one end of the second spline abutting against the locking screw, the other end of the second spine abutting against the positioning housing, the positioning housing being connected to the bearing seat;

wherein (i) the positioning housing comprises a first positioning lug, the bearing seat comprises a second positioning lug, and the mounting plate is provided with a first through-hole, and (ii) the first positioning lug, the second positioning lug, and the first through-hole are connected.

2. The lifting desk of claim 1, wherein the retaining plate is disposed between the gearbox and the desktop, a first screw connection being configured between the retaining plate and the desktop, and a second screw connection being configured between the gearbox and the retaining plate.

3. The lifting desk of claim 1, wherein the retaining plate comprises a first section and a second section which are bent relative to each other, the first section being connected to the gearbox, the second section being connected to the drive device.

4. The lifting desk of claim 3, wherein a bend angle between the first section and the second section is 90°.

5. The lifting desk of claim 1, wherein the positioning housing comprises two first positioning lugs oppositely arranged, the bearing seat comprises two second positioning lugs oppositely arranged, and the mounting plate is provided with two first through-holes oppositely arranged.

6. The lifting desk of claim 2, wherein the retaining plate comprises a first section and a second section which are bent relative to each other, the first section being connected to the gearbox, the second section being connected to the drive device.

7. The lifting desk of claim 6, wherein a bend angle between the first section and the second section is 90°.

* * * * *